US005238102A

United States Patent [19]

Langer

[11] Patent Number: 5,238,102

[45] Date of Patent: Aug. 24, 1993

[54] TRANSPORT CONTAINER

[75] Inventor: Hans-Thilo Langer, Peutenhausen, Fed. Rep. of Germany

[73] Assignee: Deutsche Aerospace A.G., Fed. Rep. of Germany

[21] Appl. No.: 941,249

[22] Filed: Sep. 4, 1992

[30] Foreign Application Priority Data

Sep. 4, 1991 [DE] Fed. Rep. of Germany ..... 4129384

[51] Int. Cl.[5] ..... F42B 39/00

[52] U.S. Cl. ..... 206/3; 220/1.5

[58] Field of Search ..... 206/3; 220/1.5

[56] References Cited

U.S. PATENT DOCUMENTS 4,248,342 2/1981 King et al. ..... 220/1.5

*Primary Examiner*—William I. Price

*Attorney, Agent, or Firm*—Evenson, McKeown, Edwards & Lenahan

[57] ABSTRACT

A transport container with an openable and closable lid for accommodating the loading and unloading of the container. The container walls and lid have a strength and elasticity which permit the withstanding of an internal pressure, which occurs up to a predetermined amount, by means of a deformation. A frame is inserted into a wall surface of the container which frame contains fragments or projectiles which are released when a defined internal pressure is exceeded to thereby force a predetermined hole in an airplane fuselage or other cargo transporter carrying the container, with a consequent controlled escape of excess container pressure through the hole.

12 Claims, 2 Drawing Sheets

TRANSPORT CONTAINER

BACKGROUND AND SUMMARY OF THE INVENTION

This invention relates to a transport container of the type having an openable lid for accommodating filling and emptying of the container and which has a strength and elasticity permitting deformation up to a predetermined amount withstanding an internal pressure.

A transport container of this general type is known from the U.S. Pat. No. 4,248,342. This transport container for the storage and transport of ammunition, explosives, etc. comprises a first tube for accommodating the ammunition; a second tube which is coaxial to the first tube; and spacer members for holding the two tubes at a fixed distance with respect to one another. The tubes have a plurality of holes which have the purpose of diminishing excess explosion pressures. In the case of an explosion of the ammunition or of the explosive, this container must prevent that in the process the whole container blasts apart in an uncontrolled manner; it should, on the contrary, because of its construction, absorb a large portion of the explosive pressure by internal deformations and allow the forming blast waves to escape laterally through the holes in the tubes. When an explosion occurs, the explosive pressure will therefore escape to all sides. The container is therefore not suitable for being stored on an airplane because, as a result of the forming of the blast waves on all sides, the whole fuselage in the area of the cargo compartment may be destroyed.

On the basis of the PCT WO 91/07337, a transport container is known for use on airplanes for the protection of the airplane structure. On the side which faces the outer airplane wall while the container is stored, this container has a wall which structurally is much weaker than the other walls. As a result, the weakened wall in the container is destroyed during an explosion, and then the pressure of the explosion, through the destroyed container wall, is supposed to rip open the opposite wall of the fuselage and escape. When the container is now stored opposite a reinforced wall part of the fuselage, there is the danger that the pressure of the explosion will not destroy the opposite wall of the fuselage but spread through the whole fuselage and rip open the fuselage at several points in an uncontrolled manner.

It is an object of the invention to provide a transport container of the initially mentioned type in which a wall situated opposite the wall of the fuselage is constructed such that the pressure of an explosion in the container acts toward the outside in a controlled manner, a hole for the escaping of the pressure of the explosion being reliably formed in the opposite wall of the fuselage.

This object is achieved by providing a transport container comprising:

container walls defining a cargo space and having sufficient strength and elasticity to withstand a predetermined internal pressure with deformation of the container walls, an openable lid for accommodating loading of cargo into the cargo space and unloading of cargo from the cargo space, said lid closing off the cargo space from the inside in a gas tight manner a frame inserted into a wall of the container, and projectiles carried by the frame in such a manner as to be forcibly released toward the outside of the container upon exposure of the container cargo space to a predetermined internal pressure, said projectiles being configured and arranged to form a predetermined opening in a cargo support wall adjacent the container during use to thereby accommodate a controlled pressure release from the container cargo space through the predetermined opening in the cargo support wall.

The invention has several advantages. When a small amount of explosives explodes in the transport container, the pressure energy is absorbed by a deformation of the container. When larger amounts of explosives explodes, for example, in an airplane transport container, their energy is used in such a manner that the cutting effect of the projectiles causes only a small hole in the fuselage that can be predetermined. This prevents that a blast wave is spread all through the fuselage. Because of the cutting effect of the projectiles, no blow-out walls (predetermined breaking points) must be provided in the airframe proper. A constructive weakening of the airframe structure therefore does not exist. A higher weight of the airframe as a result of possibly required reinforcements for absorbing discontinuities in the airframe structure because of blow-out regions is avoided. Because of the pressure-sealed closing of the lid, barometric ignition devices, which are common in assassinations become ineffective because almost the same pressure exists in the interior of the transport container as on the ground of the dispatch location. In this case, the differential pressure between the ground pressure at the dispatch location and the internal pressure of the cargo compartment during the air travel causes an additional closing force of the lid. Another safety measure for the surroundings of the transport container consists of the fact that the internal pressure releasing the fragments or projectiles is lower than the holding pressure of the lid.

Other objects, advantages and novel features of the present invention will become apparent from the following detailed description of the invention when considered in conjunction with the accompanying drawings.

DETAILED DESCRIPTION OF THE DRAWINGS

Figure 1:
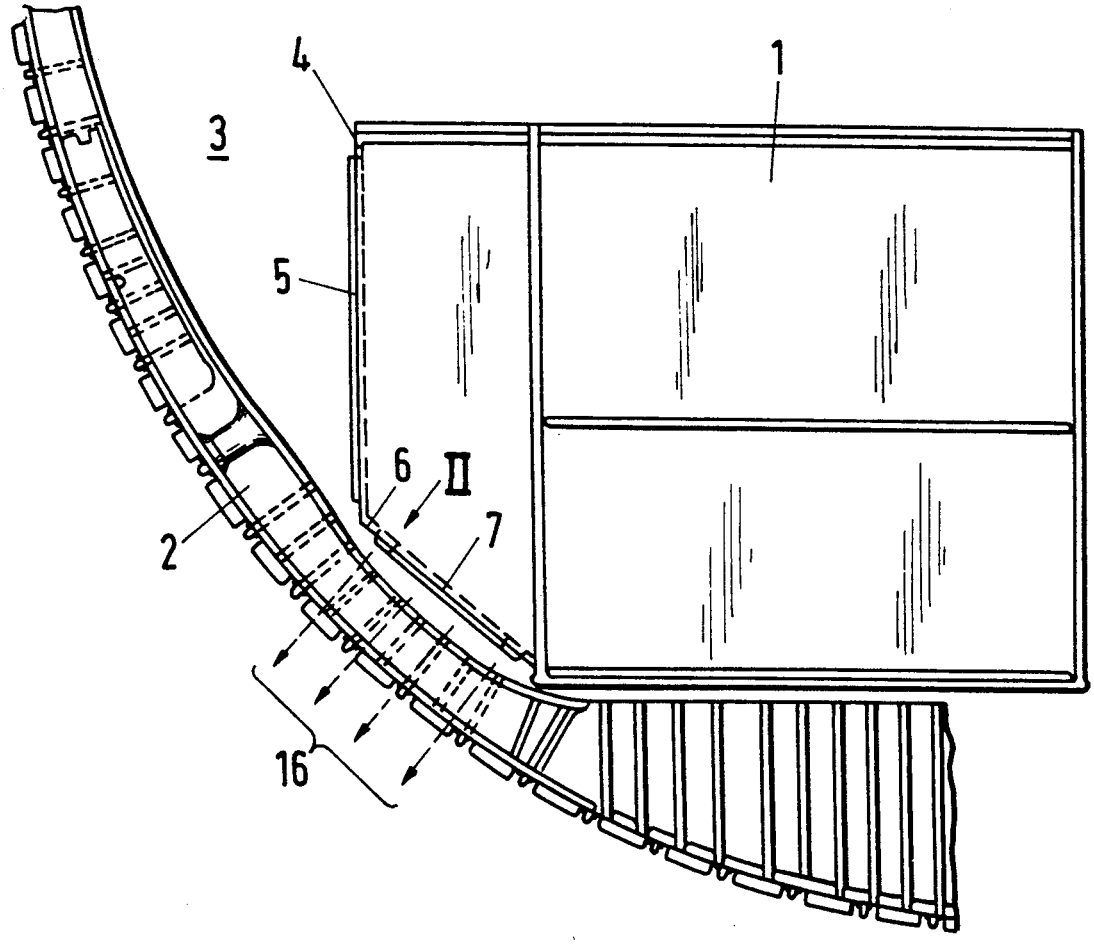
FIG. 1 is a schematic side view of a transport container constructed according to a preferred embodiment of the invention, in which the installation of the container into the cargo compartment of an airplane is schematically outlined.

Corresponding to FIG. 1, a transport container 1 is situated in a cargo compartment 3 of an airplane which is indicated by a portion of the fuselage wall 2. In a pressure-resistant manner, the transport container 1 is made of a fiber reinforced material, preferably of aramide fiber laminates and carbon fiber laminates. For the loading and unloading of the transport container 1, a side wall 4 is provided with a lid 5 which can lock the transport container 1 from the inside by means of known locking devices which are not shown. In an oblique bottom wall 6, which is customary in the case of transport containers 1 for airplanes, a frame 7 is mounted which will be explained in detail in the following by means of FIGS. 2 to 4.

Figure 2:
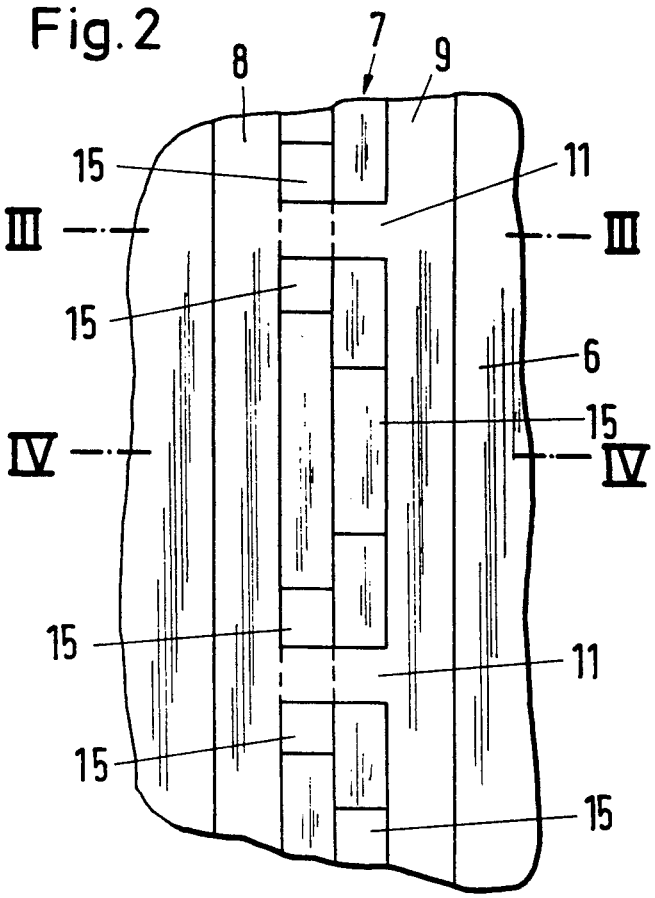
FIG. 2 is an enlarged schematic view in the direction of arrow II of FIG. 1 showing a frame with projectiles in the interior of the transport container according to FIG. 1.
Figure 3:
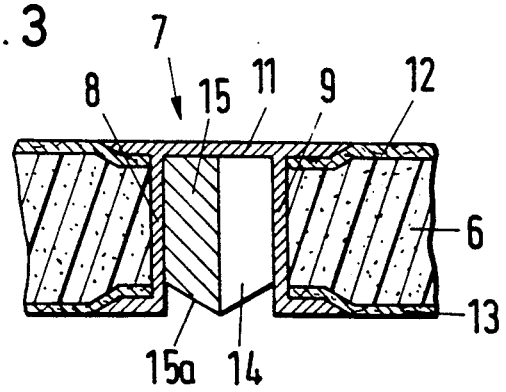
FIG. 3 is a sectional view of the frame of FIG. 2 taken along section III—III of FIG. 2.
Figure 4:
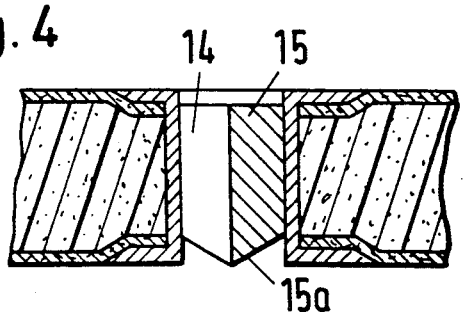
FIG. 4 is a sectional view of the frame of FIG. 2 taken along section IV—IV of FIG. 2.

Viewed in the direction II of FIG. 1, FIG. 2 shows a portion of the frame 7 which is inserted into the oblique bottom wall 6. FIGS. 3 and 4 are sectional views III—III and IV—IV of the frame 7. The frame 7 comprises two U-profiles 8 and 9 which are connected with one another by means of several webs 11. Cover layers 12 and 13 of the bottom wall 6 are inserted into the legs of the U-profiles 8 and 9. In this case, cover layer 12 represents the interior wall and cover layer 13 represents the exterior wall of the transport container. The frame 7 forms a groove-shaped opening 14 toward the outside into which projectiles 15—such as heavy-metal projectiles—are inserted which are offset with respect to one another in two rows and taper off into slanted cutting edges 15*a* on their ends pointing toward the outside.

When, as a result of an explosion within the transport container 1, a gas pressure is exerted on the projectiles 15 which causes a higher shearing force than the constructively caused retaining force by the fastening of the projectiles 15, the projectiles 15 are accelerated. Their kinetic energy acts in the direction of the arrows 16 (FIG. 1) upon the fuselage wall 2 and cuts out a hole corresponding to the frame 7, the hole representing a defined blow-out opening for the gases of the explosion.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A transport container comprising:

container walls defining a cargo space and having sufficient strength and elasticity to withstand a predetermined internal pressure with deformation of the container walls, an openable lid for accommodating loading of cargo into the cargo space and unloading of cargo from the cargo space, said lid closing off the cargo space from the inside in a gas tight manner, a frame inserted into a wall of the container, and projectiles carried by the frame in such a manner as to be forcibly released toward the outside of the container upon exposure of the container cargo space to a predetermined internal pressure, said projectiles being configured and arranged to form a predetermined opening in a cargo support wall adjacent the container during use to thereby accommodate a controlled pressure release from the container cargo space through the predetermined opening in the cargo support wall.

2. A transport container according to claim 1, wherein the container walls are made of fiber reinforced materials.

3. A transport container according to claim 1, wherein the projectiles are offset with respect to one another in two rows in the frame, said projectiles being inserted in an opening of the frame which is groove-shaped toward the outside of the container.

4. A transport container according to claim 3, wherein the projectiles have slanted cutting edges which are directed toward the outside of the container.

5. A transport container according to claim 1, wherein the predetermined internal pressure for releasing the projectiles is lower than the holding pressure of the lid such that the projectiles are released at lower internal cargo pressures than would cause opening of the lid.

6. A transport container according to claim 1, wherein the container is configured for transport in an airplane fuselage, and wherein the frame is disposed in an oblique container wall which is adapted to the curvature of the airplane fuselage.

7. A transport container according to claim 2, wherein the projectiles are offset with respect to one another in two rows in the frame, said projectiles being inserted in an opening of the frame which is groove-shaped toward the outside of the container.

8. A transport container according to claim 2, wherein the predetermined internal pressure for releasing the projectiles is lower than the holding pressure of the lid such that the projectiles are released at lower internal cargo pressures than would cause opening of the lid.

9. A transport container according to claim 7, wherein the predetermined internal pressure for releasing the projectiles is lower than the holding pressure of the lid such that the projectiles are released at lower internal cargo pressures than would cause opening of the lid.

10. A transport container according to claim 7, wherein the container is configured for transport in an airplane fuselage, and wherein the frame is disposed in an oblique container wall which is adapted to the curvature of the airplane fuselage.

11. A transport container according to claim 8, wherein the container is configured for transport in an airplane fuselage, and wherein the frame is disposed in an oblique container wall which is adapted to the curvature of the airplane fuselage.

12. A transport container according to claim 9, wherein the container is configured for transport in an airplane fuselage, and wherein the frame is disposed in an oblique container wall which is adapted to the curvature of the airplane fuselage.

* * * * *